United States Patent [19]

King

[11] Patent Number: 4,689,518

[45] Date of Patent: Aug. 25, 1987

[54] HIGH PRESSURE DISCHARGE LAMP MOUNTING STRUCTURE

[75] Inventor: Norman R. King, Hammondsport, N.Y.

[73] Assignee: North American Philips Corporation, New York, N.Y.

[21] Appl. No.: 810,804

[22] Filed: Dec. 19, 1985

[51] Int. Cl.[4] ..... H01J 61/34

[52] U.S. Cl. ..... 313/1; 313/25; 313/634

[58] Field of Search ..... 313/1, 25, 17, 634

[56] References Cited

U.S. PATENT DOCUMENTS 4,287,454 9/1981 Feuersanger et al. ..... 315/178
4,401,912 8/1983 Martzloff et al. ..... 313/634 X

FOREIGN PATENT DOCUMENTS 845617 8/1960 United Kingdom ..... 313/25

*Primary Examiner*—Palmer C. DeMeo
*Assistant Examiner*—Sandra L. O'Shea
*Attorney, Agent, or Firm*—Robert T. Mayer

[57] ABSTRACT

A high pressure discharge lamp with a multi-bent wire frame which provides symmetrical orientation and improved structural support for a pair of discharge devices which are supported at their tops by an element which allows for differential expansion of the devices.

4 Claims, 6 Drawing Figures

FIG.1
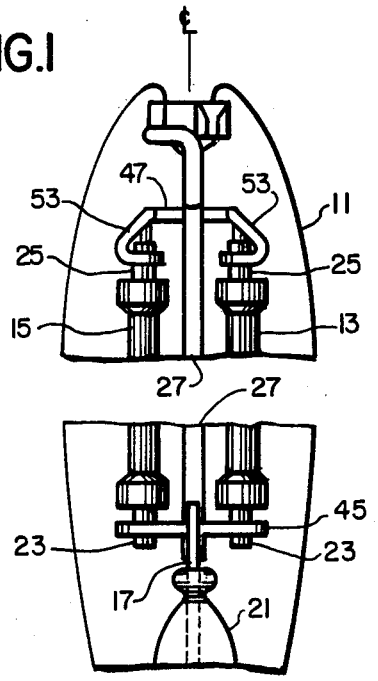
FIG.2
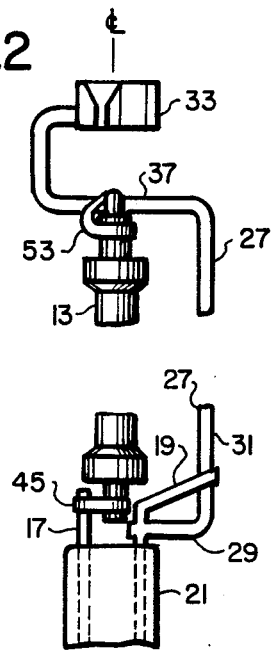
FIG.3
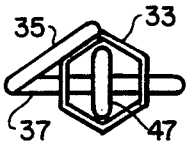
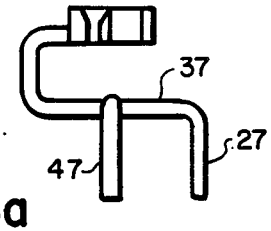
FIG.3a
FIG.4
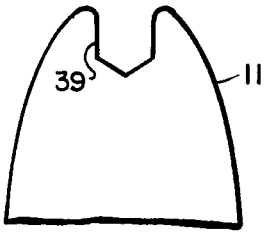
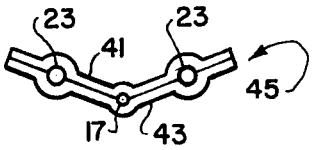
FIG.5
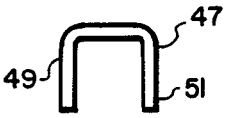
FIG.6

HIGH PRESSURE DISCHARGE LAMP MOUNTING STRUCTURE

This is an invention in the lamp art. More particularly, it concerns an arrangement for mounting two high pressure discharge tubes in one envelope.

High pressure discharge lamps with two discharge tubes mounted in one envelope are known per se. One of the difficulties with manufacturing such lamps in the past was making the structural support for the tubes strong enough yet not unduly complex. When the structural support is complex, it complicates manufacturing processes. Furthermore, it is desirable that the structural support also allow the tubes to expand differentially since they are always on one at a time.

It is an object of this invention to provide an improved discharge lamp having two discharge tubes.

One of the features of the invention is the provision of a dimple in the lamp's envelope in combination with a single wire frame that is simpler than previous designs. The frame has a multiplicity of bends. It engages the dimple to give rigid support to the tubes of the lamp and yet it allows differential expansion of the tubes without undergoing undue stress.

One of the advantages of the invention is that it provides a discharge lamp with two discharge tubes which is easier to manufacture than prior structures.

In accordance with the invention, there is provided a high pressure discharge lamp including a light transmitting envelope. Two discharge means are provided in the envelope. Coupling means adapted to couple the discharge means to a source of voltage located outside the envelope is also provided. The coupling means also mount the discharge means side-by-side and parallel to each other equidistant from the longitudinal axis of the envelope. A dimple is formed in the envelope at its upper end. The dimple is disposed in the interior of the envelope and is substantially centered on the axis of the envelope. The coupling means includes a multi-bent wire frame. Except for that portion of the frame located after its uppermost bend, the frame is located in the plane which passes through the axis of the envelope and which is perpendicular to the plane passing through the axes of the two discharge means. A spring clip is welded to the portion of the frame located after its uppermost bend. The clip snugly engages the dimple on the envelope to provide structural support for the frame.

Other objects, features and advantages of the invention will become apparent from the following description and appended claims when considered in conjunction with the accompanying drawing in which:

FIG. 1 is a partial schematic view of a high pressure discharge lamp with two discharge tubes made in accordance with the invention;

FIG. 2 is a partial side view of the support structure of the tubes of the lamp of FIG. 1;

FIGS. 3 and 3*a* are a partial plan view and a partial side view, respectively, of the upper tube locating and supporting elements of the structure of FIG. 2;

FIG. 4 is a partial view of the envelope of the lamp of FIG. 1 including the internal dimple thereof;

FIG. 5 is a plan view of the lower tube locating and coupling elements of the lamp of FIG. 1; and FIG. 6 is a side view of the upper tube locating element of FIG. 3.

Referring to FIG. 1, there is shown a light transmitting vitreous envelope 11. Mounted in envelope 11 are two discharge means 13 and 15. Lead wires 17 and 19 (FIG. 2) are brought into envelope 11 through sealing means 21 in suitable well known manner. In this way a source of voltage located outside envelope 11 can be connected to the tubular electrode structures 23 and 25 of discharge means 13 and 15. Lead wires 17 and 19 comprise part of the coupling means of the lamp. Also comprising part of the coupling means is multi-bent wire frame 27 (FIG. 2). At its lowestmost bend, wire frame 27 forms horizontal leg 29 and vertical leg 31. Lead wire 19 is bent in the manner shown in FIG. 2 and is welded to both the horizontal and vertical legs of frame 27. These welds provide part of the structural support for frame 27.

It is to be understood that an alternative embodiment has been contemplated in which frame 27 after forming leg 29 is bent downwardly again and itself comprises a lead wire in place of lead wire 19 shown in FIG. 2. This would eliminate the need for the welds mentioned above.

Located after the uppermost bend of wire frame 27 and welded thereto is spring clip 33. As can be seen from FIG. 3, this clip in the disclosed embodiment is hexagonally shaped. As can also be seen from FIG. 3, the uppermost leg 35 of wire frame 27 is out of line with horizontal leg 37 of frame 27. The remainder of the frame as can be seen from FIG. 1 is located in the plane which passes through the center line or axis of envelope 11 and which is perpendicular to the plane passing through the axes of discharge means 13 and 15.

As can be seen from FIGS. 1 and 4, there is formed in the upper end of envelope 11 a dimple 39. This dimple is disposed in the interior of the envelope and is substantially centered on the center line of envelope 11. Spring clip 33 snugly engages dimple 39 to provide structural support for frame 27.

Two flat straps of metal 41 and 43 (FIG. 5) are welded together around lead wire 17 and tubular electrode structures 23 to form the lower support 45 for discharge means 13 and 15. Lower support 45 is also part of the coupling means of the invention and provides electrical connection between lead wire 17 and lower tubular electrode structures 23.

Support 45 also secures and locates the lower ends of tubes 13 and 15 as desired. In this way, with the later to be described upper locating elements, tubes 13 and 15 are secured in a plane parallel to the longitudinal axis of envelope 11 and are symmetrical thereabout. While two separate straps 41 and 43 are disclosed, it is obvious that one strap of sufficient length to go around electrode structures 23 and lead wire 17 twice could be employed.

Spot welded to horizontal arm 37 of frame 27 is a U-shaped member 47 (FIGS. 3*a* and 6). Legs 49 and 51 of member 47 are inserted into the open ends of tubular electrode structures 25 of discharge means 13 and 15 to provide upper stability for those means. Legs 49 and 51 comprise the upper locating and supporting elements for tubes 13 and 15. This arrangement allows for differential expansion and contraction of tubes 13 and 15 during lamp operation. Electrical connection is made to electrode structures 25 in any well known manner such as by round wire or flat strap material. Such connections are designated by the numeral 53 in FIGS. 1 and 2.

Various modifications of the above described embodiment will be apparent to those skilled in the art. For that reason the arrangement described herein is for illustrative purposes and is not to be considered restrictive.

What is claimed is:

1. A high-pressure discharge lamp including a light transmitting envelope, two discharge means, each with a top having tubular electrode structure, coupling means adapted to couple said discharge means to a source of voltage located outside said envelope, said coupling means also mounting said discharge means side-by-side and parallel to each other equidistant from the longitudinal axis of said envelope, said coupling means including both means inside each tubular electrode structure structurally stabilizing the top of each said discharge means and means on the outside of each tubular electrode structure providing an electrical connection to the top of each said discharge means, a dimple formed in said envelope at its upper end disposed in the interior of the envelope and substantially centered on said axis, said coupling means including a multi-bent wire frame which except for that portion of said frame located after the uppermost bend therein is located in the plane passing through said axis and perpendicular to the plane passing through the axes of the discharge means, a spring clip welded to said portion of said frame located after said uppermost bend, said clip snugly engaging said dimple to provide structural support for said frame.

2. A high-pressure discharge lamp according to claim 1, wherein said frame has more than two bends and the bend above the lowermost one forms a horizontal leg, and said coupling means includes a U-shaped support welded to said horizontal leg with the legs of the U pointing downwardly and inserted in the tubular electrode structures of said discharge means, whereby said discharge means can expand and contract differentially during operation of said lamp.

3. A high-pressure discharge lamp according to claim 2, wherein said coupling means includes a pair of lead wires passing through a seal from inside to outside said envelope and each discharge means has a tubular electrode structure at its bottom, said coupling means including an electrically conductive strap wrapped around one of said lead wires and around both said lower electrode structures to provide electrical connection between said lead wire and said lower structures, said strap also locating said discharge means as desired and providing structural support therefor.

4. A high-pressure discharge lamp according to claim 3, wherein the other of said lead wires is bent inside said envelope, said wire frame at its lowestmost bend forming a vertical and a second horizontal leg both of which are welded to said bent lead wire.

* * * * *